United States Patent [19]

Tippins et al.

[11] Patent Number: 4,503,697

[45] Date of Patent: Mar. 12, 1985

[54] METHOD FOR HOT ROLLING SLABS

[75] Inventors: George W. Tippins; Vladimir B. Ginzburg, both of Pittsburgh, Pa.

[73] Assignee: Tippins Machinery Company, Inc., Pittsburgh, Pa.

[21] Appl. No.: 481,875

[22] Filed: Apr. 11, 1983

Related U.S. Application Data

[63] Continuation-in-part of Ser. No. 460,387, Jan. 25, 1983, abandoned.

[51] Int. Cl.[3] ..... B21B 41/02

[52] U.S. Cl. ..... 72/202; 72/229; 72/234

[58] Field of Search ..... 72/226, 227, 231, 234, 72/202, 200, 229

[56] References Cited

U.S. PATENT DOCUMENTS

| | | | |
|---|---|---|---|
| 2,658,741 | 11/1953 | Schmidt et al. | 72/200 |
| 3,331,232 | 7/1967 | King | 72/229 |
| 4,348,882 | 9/1982 | Tippins | 72/202 |

OTHER PUBLICATIONS

McGannon, H. E., *The Making, Shaping, and Treating of Steel,* U.S. Steel Corp., 1964, pp. 894–900.

*Primary Examiner*—E. Michael Combs

*Attorney, Agent, or Firm*—Webb, Burden, Robinson & Webb

[57] ABSTRACT

A method for hot rolling metal slabs to strip thicknesses comprises close coupling a hot reversing mill having a coiler furnace on at least the upstream side thereof with a finishing train having at least one finishing stand and preferably at least three finishing stands. The finishing train is maintained in the open position as the slab is passed back and forth through the hot reversing mill in flat passes with the slab freely passing through the finishing train. At an intermediate thickness the workpiece is coiled in the coiler furnace. In one embodiment a downstream coiler furnace is employed and the workpiece is reduced by passing it back and forth between the coiler furnaces while it is acted upon by the hot reversing mill. The coil is finally decoiled out of the upstream coiling furnace and passed through the finishing train which has been reset to the appropriate roll gaps during the intermediate rolling stage between coiler furnaces. In a second embodiment a single coiling furnace is employed and the workpiece is coiled in the upstream coiling furnace and then passed through the reversing mill and the finishing train. In a preferred embodiment initial and/or intermediate passes are taken in tandem to reduce time and temperature losses.

4 Claims, 7 Drawing Figures

METHOD FOR HOT ROLLING SLABS

CROSS REFERENCE TO RELATED APPLICATION

This application is a continuation-in-part application of U.S. Ser. No. 460,387 filed Jan. 25, 1983 and now abandoned.

FIELD OF THE INVENTION

Our invention relates to hot strip mills and more particularly to compact mills of the mini type used to reduce slabs of steel, other metals and alloys to strip thicknesses.

DESCRIPTION OF THE PRIOR ART

Conventional hot strip mills include a roughing train consisting of one or more mill stands spaced for individual passes and a finishing train consisting of a plurality of mill stands spaced for a tandem pass. A slab enters the roughing train where it is reduced to a transfer bar of intermediate thickness. The transfer bar which is of considerable length enters the finishing train where it is reduced to strip thicknesses. Such conventional hot strip mills enjoy high productivity and adequate quality from the standpoint of shape and metallurgical properties. Major drawbacks to a conventional mill include extremely high initial cost, large space requirements and limited versatility in terms of product mix.

With a greater demand for versatility and product mix at reasonable productivity levels, combination mills have been adopted for hot strip rolling. These combination mills include hot reversing stands for passing a slab back and forth in a roughing mode. Thereafter the slab which has been reduced to a transfer bar is passed into the finishing train which may also include a hot reversing mill having coiler furnaces on either side thereof for receiving a workpiece of a thickness capable of being coiled. Such a finishing train also includes additional finishing mill stands which are speed matched with the last pass through the hot reversing mill to complete the rolling operation. Certain combination mills or mini mills, as they are sometimes called, tend to provide only mediocre shape and surface quality. In addition, poor roll life is characteristic of such mills.

A need remains for a compact hot strip mill which combines the quality features of a conventional hot strip mill with the versatile product mix capability of the so-called combination mill. Such a mill must also have a limited space requirement and low installation cost in comparison to the conventional hot strip mill. The mill must provide excellent shape and surface quality at reasonable roll lives. In addition, the mill should have the capability to conserve energy and minimize heat loss in the strip during rolling.

SUMMARY OF THE INVENTION

Our mill is compact and can be installed within limited space requirements at a reasonable initial cost. Our mill retains the quality characteristics of the continuous hot strip mill while achieving versatility in terms of product mix at reasonable productivity levels. Desirable metallurgical, as well as shape and surface quality requirements, are achievable as are reasonable rolling times and roll lives. Our mill and method of rolling conserves temperature by eliminating the transfer time between rolling in the roughing mode and rolling in the finishing mode. This conservation of temperature not only provides for minimal front to tail temperature difference in the final product but also permits lower reheat temperatures and resultant energy requirements for the reheat furnace. High finishing temperatures are achievable which may result in the elimination of subsequent heat treatments in specialty alloys such as austenitic stainless steels.

Our hot strip mill includes a hot reversing mill having at least a first coiling furnace on the upstream side thereof. In one embodiment a second coiling furnace is positioned on the downstream side as well. The hot reversing mill operates in both a roughing mode and a finishing mode. The finishing train consisting of at least one finishing stand and preferably at least three finishing stands is close coupled to the hot reversing mill by a distance less than the length of an intermediate workpiece so that the finishing train is maintained in an open position while the slab is being rolled on the hot reversing mill and so said slab can freely pass through the finishing train. At a thickness which can be coiled, the workpiece is passed back and forth through the hot reversing mill and between the two coiler furnaces or is coiled in the single coiler furnace while the finishing train roll gaps are reset for the final downstream pass through the roughing mill and the mill stands of the finishing train.

In a preferred form of the invention, an upstream coiler is used with a four stand mill in which the initial passes are taken on the first stand and the intermediate passes are taken on the first two stands rolling is tandem and thereafter the workpiece is coiled prior to reduction by all four stands in a finishing pass. The initial passes may also be taken on the first two stands in tandem. In this manner, the final two stands are utilized for finishing to preserve surface quality and the tandem rolling reduces the time of rolling and in conjunction with coiling conserves energy and maintains high temperatures.

DESCRIPTION OF THE PREFERRED EMBODIMENTS

Figure 1:
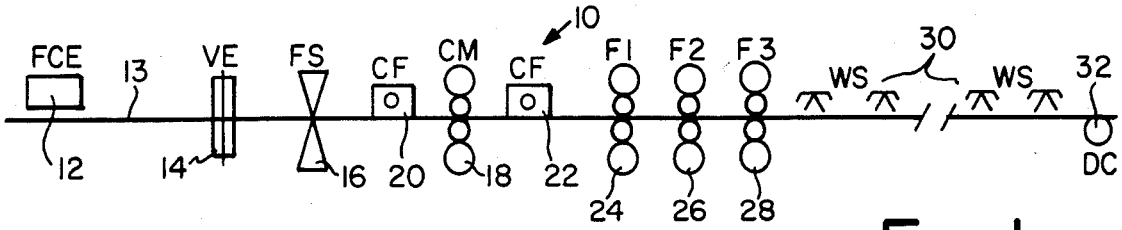
FIG. 1 is a schematic of our hot strip mill utilizing two coiler furnaces, a combination mill and three finishing stands.

Our hot strip mill generally designated 10 comprises a dual functioning four high hot reversing combination mill (CM) 18 having a coiling furnace (CF) 20 upstream thereof and a coiling furnace (CF) 22 downstream thereof and a finishing train comprised of three (F1, F2, F3) four high finishing mills 24, 26 and 28, FIG. 1. Upstream of the combination mill 18 and the coiler furnace 20 is a furnace (FCE) 12, a vertical edger (VE)

14 and a flying shear (FS) 16. Downstream of the finishing train are a plurality of water sprays (WS) 30 and a downcoiler (DC) 32. The auxiliary equipment is standard, can be varied and does not form a part of this invention. Slabs being reduced to strip thicknesses are conveyed along a pass line 13 by conveyor rolls not shown.

The combination mill 18 is used both as a roughing mill for rolling flat passes in a roughing mode and a preliminary finishing mill for further reducing the workpiece as it is passed back and forth between the coiler furnaces 20 and 22. The finishing train is closely spaced to the combination mill 18 and the rolls of the finishing train 24, 26 and 28 are maintained in the open position so that the flat passes through the combination mill 18 are free to pass through the finishing mill in a non-engaging mode. The roll gaps of the finishing train are reset while the workpiece is being reduced through passes between the coiler furnaces.

Since multiple passes are taken on the combination mill vis-a-vis the individual mills of the finishing train, it is desirable to equalize the roll life of the respective mills. This is accomplished by using roll lubrication on the combination mill to obtain a roll life comparable to that of the individual finishing stands.

Figure 2:
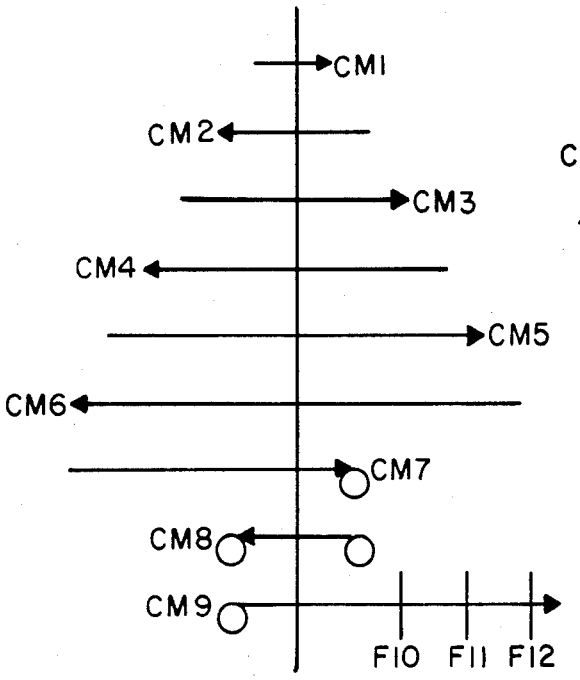
FIG. 2 is a schematic showing a 12 pass roll schedule for the mill of FIG. 1.

A typical 12 pass rolling schedule is illustrated in FIG. 2. The first 6 passes (CM1–CM6) are flat passes back and forth through the hot reversing mill. In this mode the work rolls of the finishing train are kept open so that when the slab reaches a length greater the distance between the combination mill and the finishing train, the workpiece freely passes through the finishing mill as if it didn't exist. Similarly, the vertical edger and flying shear are mounted in the open position on the upstream side of the combination mill. On the 7th pass (CM7) through the combination mill the slab has been reduced to a thickness capable of being coiled in the downstream coiler furnace 22. The strip is thereafter decoiled in a reverse direction and passed (CM8) back through the combination mill into the upstream coiling furnace 20. During this reverse pass (CM8) the roll gaps of the finishing stands are reset to receive the workpiece in a finishing mode. The 9th pass (CM9) is in a forward direction out of the upstream coiler furnace through the combination mill and the final three passes are through the three finishing stands F1, F2 and F3 respectively. Leaving the finishing train the reduced strip is subjected to cooling by water sprays and is finally coiled on a downcoiler or an upcoiler in conventional manner.

A detailed rolling schedule for low carbon steel incorporating the pass schedule of FIG. 2 is illustrated in Table One. The distance between the combination mill and the first finishing mill stand is 40 feet, and the finishing stands are 18 feet apart.

From the above roll schedule it can be seen that temperature differentials between the front and tail of the workpiece are maintained at acceptable levels, thereby assuring uniformity in respect of metallurgical properties and ease of rolling resulting from equalized separation forces for the mills from the front to the tail of the workpiece being rolled.

While it is possible to use any number of finishing stands, we have found that a minimum of three provides the optimal combination for compactness and acceptable shape and surface quality over a range of strip thicknesses.

To obtain acceptable strip profile and strip shape it is desirable to maintain a constant ratio of strip crown to strip thickness. This ratio more difficult to maintain as the thickness to width ratio becomes less than 0.005. The shape and profile generally are determined in the last three passes where the workpiece is at its thinnest. The ratio is controlled by the distribution of load between the stands (percent reduction) and crown on the rolls. Since there are practical limits to the amount of reduction in each stand, roll crowning becomes the most effective tool to maintain the desired ratio and each roll is crowned accordingly. At least three sets of finishing rolls allow for this crown control.

Resistance to deformation also increases with a decrease in thickness thereby increasing roll rear on the final stands. Again three stands provide for adequate roll wear control. This control is accomplished by progressively increasing the surface hardness of the last three stands.

Figure 3:
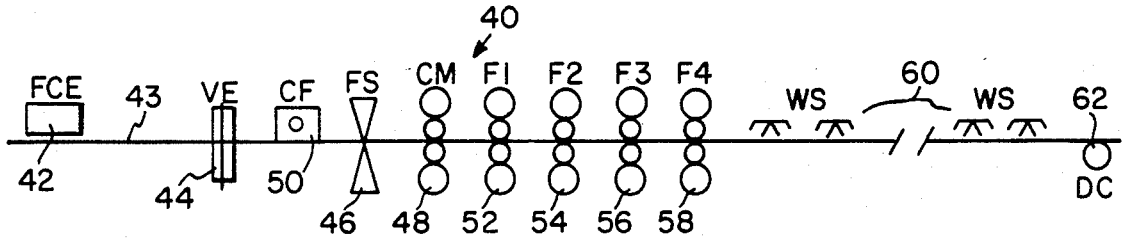
FIG. 3 is a schematic of our hot strip mill utilizing a single coiler furnace, a combination mill and four finishing stands.

The mill of FIG. 3 further optimizes shape and surface quality and demonstrates the energy savings available through the use of low slab heating temperatures. The mill generally designated 40 comprises the combination hot reversing mill (CM) 48 having a coil furnace (CF) 50 upstream thereof, and a finishing train comprised of four (F1, F2, F3 and F4) four high finishing mills 52, 54, 56 and 58. Between the combination mill 48 and the coiler furnace 50 is a flying shear (FS) 46 and upstream of the coiler furnace 50 is a vertical edger (VE) 44 and a furnace (FCE) 42. Downstream of the finishing train are a plurality of water sprays (WS) 60 and a downcoiler (DC) 62. Slabs are conveyed and reduced along the pass line 43.

Figure 4:
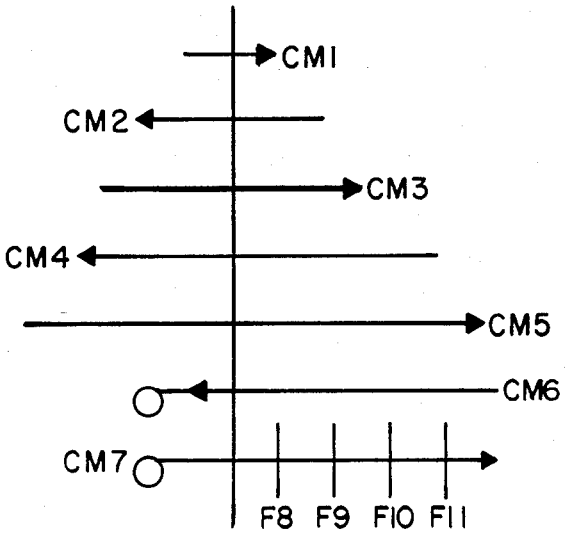
FIG. 4 is a schematic showing an 11 pass roll schedule for the mill of FIG. 3.

In the mill of FIG. 3, the finishing train mill stands are maintained open while flat passes are taken on the reversing mill. A typical rolling schedule is illustrated in FIG. 4. At the appropriate thickness (0.75 inch, see Table Two), the workpiece is coiled into the single coiler furnace while the finishing train mill stands are reset for the proper finishing pass. The workpiece is decoiled out of the coiler furnace and finally reduced through the reversing mill and the four finishing train mill stands. Since there is no downstream coiler furnace, the reversing mill can be positioned even closer to the finishing train than in the earlier embodiment. This compactness allows for lower furnace temperatures as shown in Table Two which is a detailed rolling schedule for the pass practice illustrated in FIG. 4.

The shortened distance (for example 18 feet between CM and F1) and the low furnace exit temperature of 2000° F. results in less scale and improved surface quality at acceptable mill load levels.

Both embodiments provide a mill and method of rolling which results in a quality product at reasonable installation cost.

Figure 5:
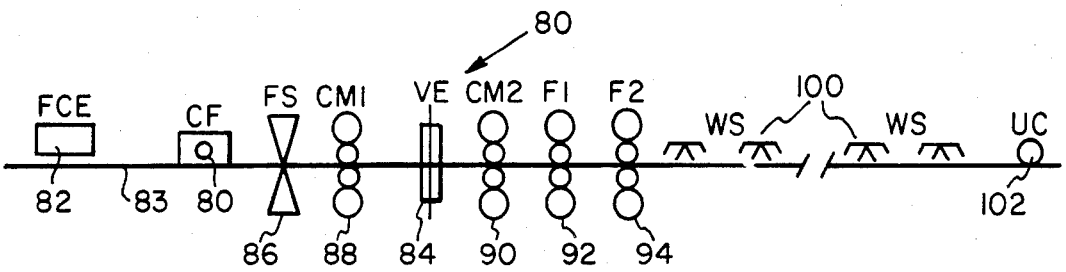
FIG. 5 is a schematic of our hot strip mill utilizing a single coiler furnace, a pair of combination mills for rolling in tandem and two finishing stands.

The mill of FIG. 5 represents a preferred form of the invention in that energy conservation is maximized and temperature loss to the strip is minimized. The mill generally designated 80 comprises two hot reversing mills (CM1 and CM2) 88 and 90 having a coiler furnace (CF) 80 upstream of hot reversing mill (CM1) 88 and two finishing mill stands (F1 and F2) 92 and 94. In this embodiment the vertical edger (VE) 84 is just downstream of hot reversing mill (CM1) 88. The slabs are conveyed along pass line 83 from the furnace (FCE) 82 and a flying crop shear (FS) 86 is located between the coiler furnace (CF) 80 and the first hot reversing mill (CM1) 88. Water sprays (WS) 100 are located downstream of the last finishing stand (F2) 94 and upstream of upcoiler (UC) 102.

Figure 6:
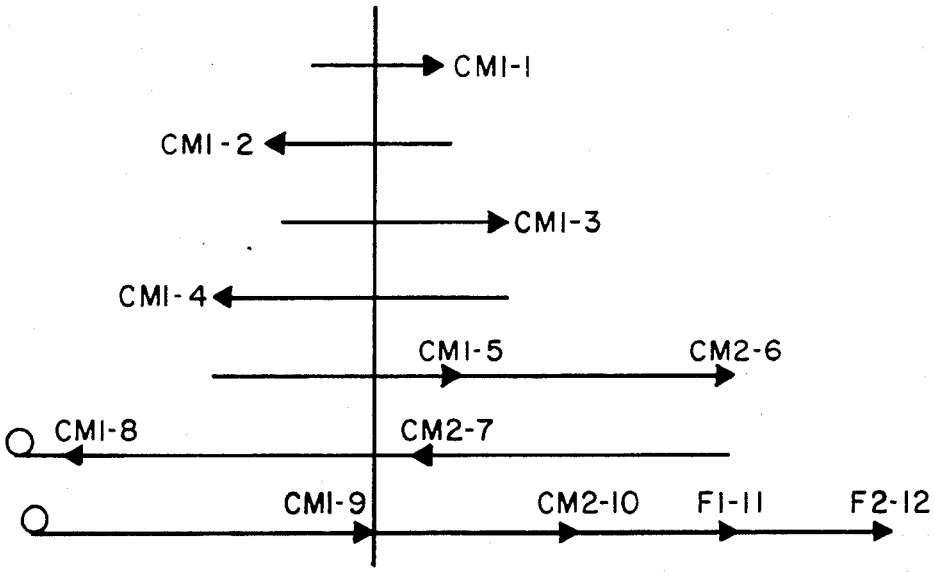
FIG. 6 is a schematic showing a 12 pass roll schedule for the mill of FIG. 5.

The advantage of mill 80 resides in the method of rolling as illustrated in FIG. 6 and Table Three. The initial passes are back and forth through the first mill CM1 while the remainder of the mills are maintained in the open position to permit free passage of the slab being rolled. The stands are basically an eighteen foot centers so all stands must be maintained open. If the vertical edger is positioned between the first two stands on additional five feet between the first two stands is required. The fifth and sixth passes are in the forward direction through the first two stands rolling in tandem and the seventh and eighth passes are also through the same stands in a reverse direction, but again the mills roll in tandem. These tandem passes are considered the intermediate passes. The slab has now been reduced to a strip of coilable thickness (0.56 inch) and is coiled in the single coiler furnace (CF) 80. As the mills are vacated of strip, they are reset for the final pass in which all four stands roll in tandem to the desired strip thickness.

By rolling the intermediate passes in tandem, substantial time is saved, which time also translates into decreased temperature loss. In addition, the last two mills are only used in the final pass so the roll surface is maintained without the need for constant roll change. All of this is accomplished on a four stand compact mill. For steel such as austenitic stainless, the finishing temperatures can be sufficiently high so as to eliminate certain subsequent heat treatments. For example, the steel rolled in Table Three finished above 1850° F. even though the furnace temperature was on the order of 2250° F. Of course, additional finishing stands can be added but most of the advantages can be achieved with only the total of four stands.

Figure 7:
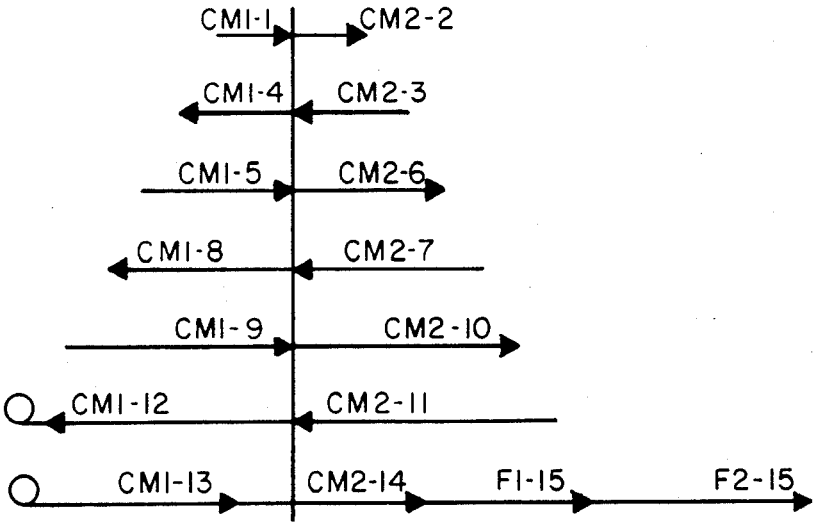
FIG. 7 is a schematic showing a 16 pass roll schedule for the mill of FIG. 5.

Another rolling schedule further modifying and improving the preferred form of the invention is illustrated in FIG. 7 and shown in Table IV. In this embodiment a sixteen pass roll is carried out in about the same lapsed roll time as the twelve pass schedule of FIG. 6 and Table III.

Passes 1 and 2, 3 and 4, 5 and 6, 7 and 8, 9 and 10, and 11 and 12, respectively, are all carried out in tandem on the first two stands CM1 and CM2. After the twelfth pass the strip is coiled and the final four passes are taken in tandem as in the embodiment of FIG. 6. It can be seen that both rolling schedules are taken in a seven step sequence so no additional steps are required to achieve four additional passes. The added advantage is that mill loads can be reduced thereby reducing the horsepower requirements of the first two mills. In addition the same roll diameters can be used on the first two mills thereby simplifying roll maintenance and inventory. Generally, in the embodiment of FIG. 6 a larger diameter roll pair is required for CM1 as compared to CM2.

TABLE ONE

SCHEDULE FOR ROLLING LOW CARBON STEEL SLAB 8.27 in × 47.24 in × 32.80 ft (21.75 tons) TO .079 in (921 PIW)

| Mill | Thickness | Entry Temp. deg. F | | Exit Temp. deg. F | | Draft | | Length | Strip Speed FPM | | Roll Time |
|---|---|---|---|---|---|---|---|---|---|---|---|
| Stand | Inches | Front | Tail | Front | Tail | % | Inches | Ft. | Front | Tail | Sec. |
| FCE | 8.27 | 2125 | 2125 | 2125 | 2125 | 0 | 0 | 32.8 | 0 | 0 | 0 |
| CM1 | 7.00 | 2094 | 2090 | 2093 | 2090 | 15.3 | 1.268 | 38.7 | 400 | 450 | 5.17 |
| CM2 | 5.80 | 2079 | 2086 | 2081 | 2087 | 17.1 | 1.200 | 46.8 | 450 | 400 | 6.23 |
| CM3 | 4.60 | 2067 | 2060 | 2065 | 2060 | 20.7 | 1.200 | 59.0 | 400 | 500 | 7.07 |
| CM4 | 3.50 | 2041 | 2054 | 2045 | 2056 | 23.9 | 1.100 | 77.5 | 550 | 400 | 8.45 |
| CM5 | 2.50 | 2023 | 2012 | 2019 | 2014 | 28.6 | 1.000 | 108.5 | 400 | 870 | 7.48 |
| CM6 | 1.50 | 1972 | 2004 | 1981 | 2009 | 40.0 | 1.000 | 180.8 | 870 | 400 | 12.47 |
| CM7* | .75 | 1938 | 1852 | 1917 | 1834 | 50.0 | 0.700 | 361.6 | 400 | 400 | 30.07 |
| CM8 | .36 | 1821 | 1811 | 1781 | 1773 | 52.0 | .400 | 753.3 | 400 | 400 | 57.08 |
| CM9 | .195 | 1740 | 1689 | 1747 | 1703 | 45.8 | .200 | 1390.7 | 567 | 729 | 128.73 |
| F1 | .124 | 1688 | 1660 | 1689 | 1668 | 36.4 | .076 | 2187.0 | 891 | 1147 | 128.73 |
| F2 | .093 | 1664 | 1649 | 1654 | 1645 | 25.0 | .031 | 2916.0 | 1189 | 1529 | 128.73 |
| F3 | .079 | 1631 | 1627 | 1611 | 1612 | 15.1 | .014 | 3432.8 | 1400 | 1800 | 128.73 |

*Coiling begins at Mill Stand CM7

TABLE TWO

SCHEDULE FOR ROLLING LOW CARBON STEEL SLAB 8.27 in × 47.24 in × 32.80 ft (21.75 tons) TO .079 in (921 PIW)

| Mill | Thickness | Entry Temp. deg. F | | Exit Temp. deg. F | | Draft | | Length | Strip Speed FPM | | Roll Time |
|---|---|---|---|---|---|---|---|---|---|---|---|
| Stand | Inches | Front | Tail | Front | Tail | % | Inches | Ft. | Front | Tail | Sec. |
| FCE | 8.27 | 2000 | 2000 | 2000 | 2000 | 0 | 0 | 32.8 | 0 | 0 | 0 |
| CM1 | 6.85 | 1989 | 1985 | 1989 | 1986 | 17.2 | 1.418 | 39.6 | 400 | 400 | 5.28 |
| CM2 | 5.40 | 1977 | 1982 | 1977 | 1983 | 21.2 | 1.450 | 50.2 | 400 | 400 | 6.70 |
| CM3 | 3.95 | 1964 | 1957 | 1965 | 1957 | 26.9 | 1.450 | 68.7 | 400 | 400 | 8.24 |
| CM4 | 2.50 | 1937 | 1952 | 1945 | 1959 | 36.7 | 1.450 | 108.5 | 400 | 400 | 11.83 |
| CM5 | 1.50 | 1919 | 1894 | 1925 | 1900 | 40.0 | 1.000 | 180.8 | 400 | 400 | 12.47 |
| CM6* | .075 | 1803 | 1888 | 1812 | 1894 | 50.0 | 0.750 | 361.6 | 400 | 400 | 32.82 |
| CM7 | 0.36 | 1790 | 1737 | 1735 | 1697 | 52.7 | 0.395 | 763.9 | 312 | 367 | 135.06 |
| F1 | 0.195 | 1708 | 1676 | 1716 | 1688 | 45.1 | 0.160 | 1390.7 | 567 | 669 | 135.06 |
| F2 | 0.124 | 1690 | 1667 | 1690 | 1672 | 36.4 | 0.071 | 2187.0 | 892 | 1051 | 135.06 |
| F3 | 0.093 | 1666 | 1652 | 1655 | 1646 | 25.0 | 0.031 | 2916.0 | 1189 | 1402 | 135.06 |
| F4 | 0.079 | 1632 | 1626 | 1612 | 1610 | 15.1 | 0.014 | 3432.8 | 1400 | 1650 | 135.06 |

*Coiling occurs at Mill Stand CM6

TABLE THREE

SCHEDULE FOR ROLLING TYPE 304 STAINLESS STEEL SLAB 7.875 in × 40 in × 36.8 ft (19.7 tons) TO 0.98 in (984 PIW)

| Mill Stand | Thickness Inches | Entry Temp. deg. F Front | Entry Temp. deg. F Tail | Exit Temp. deg. F Front | Exit Temp. deg. F Tail | Draft % | Draft Inches | Length Ft. | Strip Speed FPM Front | Strip Speed FPM Tail | Roll Time Sec. |
|---|---|---|---|---|---|---|---|---|---|---|---|
| FCE | 7.875 | 2250 | 2250 | 2250 | 2250 | 0 | 0 | 36.8 | 0 | 0 | 0 |
| CM1-1 | 6.225 | 2235 | 2229 | 2234 | 2229 | 21.0 | 1.65 | 46.6 | 492 | 492 | 5.68 |
| CM1-2 | 4.575 | 2213 | 2223 | 2216 | 2226 | 26.5 | 1.65 | 63.3 | 492 | 492 | 7.72 |
| CM1-3 | 3.00 | 2208 | 2189 | 2207 | 2188 | 34.4 | 1.575 | 96.6 | 492 | 492 | 11.78 |
| CM1-4 | 2.10 | 2142 | 2178 | 2147 | 2180 | 30.0 | 0.90 | 138.0 | 600 | 600 | 13.80 |
| CM1-5 | 1.70 | 2133 | 2094 | 2132 | 2095 | 19.0 | 0.40 | 170.5 | 841.2 | 841.2 | 12.16 |
| CM2-6 | 1.30 | 2127 | 2090 | 2123 | 2087 | 23.5 | 0.40 | 222.9 | 1100. | 1100. | 12.16 |
| CM2-7 | 0.85 | 2067 | 1960 | 2063 | 1975 | 34.6 | 0.45 | 340.9 | 223.2 | 707.4 | 38.27 |
| CM1-8* | 0.56 | 2027 | 1965 | 2028 | 1982 | 34.1 | 0.29 | 517.4 | 400 | 1200 | 34.04 |
| CM1-9 | 0.293 | 1954 | 1944 | 1969 | 1960 | 47.7 | 0.267 | 989 | 535.2 | 535.2 | 110.88 |
| CM2-10 | 0.170 | 1932 | 1924 | 1944 | 1936 | 42.0 | 0.123 | 1704.5 | 922.4 | 922.4 | 110.88 |
| F1-11 | 0.123 | 1916 | 1909 | 1914 | 1907 | 276. | 0.047 | 2355.9 | 1274.8 | 1274.8 | 110.88 |
| F2-12 | 0.098 | 1888 | 1881 | 1879 | 1873 | 20.3 | 0.025 | 2956.8 | 1600. | 1600. | 110.88 |

*Coiling occurs after CM1-8

TABLE FOUR

SCHEDULE FOR ROLLING TYPE 304 STAINLESS STEEL SLAB 7.875 in × 40 in × 36.8 ft (19.7 tons) TO 0.98 in (984 PIW)

| Mill Stand | Thickness Inches | Entry Temp. deg. F Front | Entry Temp. deg. F Tail | Exit Temp. deg. F Front | Exit Temp. deg. F Tail | Draft % | Draft Inches | Length Ft. | Strip Speed FPM Front | Strip Speed FPM Tail | Roll Time Sec. |
|---|---|---|---|---|---|---|---|---|---|---|---|
| FCE | 7.8750 | 2250. | 2250. | 2250. | 2250. | 0 | 0 | 36.8 | 0 | 0 | 0 |
| CM1-1 | 7.000 | 2235.2 | 2231.2 | 2233.1 | 2229.1 | 11.1 | .875 | 41.4 | 600 | 600 | 4.14 |
| CM2-2 | 6.000 | 2230.6 | 2226.6 | 2231.4 | 2227.6 | 14.3 | 1.000 | 48.3 | 700 | 700 | 4.14 |
| CM2-3 | 5.1500 | 2213.5 | 2221.5 | 2213.8 | 2221.6 | 14.2 | .850 | 56.3 | 591.3 | 591.3 | 5.71 |
| CM1-4 | 4.3500 | 2210.6 | 2218.4 | 2211.2 | 2218.8 | 15.5 | .800 | 66.6 | 700. | 700. | 5.71 |
| CM1-5 | 3.7000 | 2203.3 | 2191.7 | 2200.0 | 2188.7 | 14.9 | .650 | 78.3 | 712.2 | 712.2 | 6.60 |
| CM2-6 | 3.1000 | 2196.5 | 2185.2 | 2196.9 | 2185.8 | 16.2 | .600 | 93.5 | 850. | 850. | 6.60 |
| CM2-7 | 2.6000 | 2156.2 | 2175.5 | 2156.5 | 2175.4 | 16.1 | .500 | 111.4 | 807.7 | 807.7 | 8.28 |
| CM1-8 | 2.1000 | 2152.6 | 2171.3 | 2153.8 | 2172.0 | 19.2 | .500 | 138. | 1000. | 1000. | 8.28 |
| CM1-9 | 1.6500 | 2139.7 | 2097.2 | 2139.6 | 2098.4 | 21.4 | .450 | 175.6 | 763.6 | 763.6 | 13.80 |
| CM2-10 | 1.2000 | 2133.2 | 2092.5 | 2136.7 | 2097.7 | 27.3 | .450 | 241.4 | 1050. | 1050. | 13.80 |
| CM2-11 | .7500 | 1929.3 | 2075.7 | 1948. | 2085.9 | 37.5 | .450 | 386.3 | 734.4 | 734.4 | 32.91 |
| CM1-12* | .5100 | 1937.7 | 2073. | 1952.2 | 2079.7 | 32. | .240 | 568.1 | 1080. | 1080. | 109.15 |
| CM1-13 | .2930 | 1912.6 | 1945.7 | 1926.1 | 1957.0 | 42.5 | .217 | 988.8 | 568.8 | 568.8 | 109.15 |
| CM2-14 | .1700 | 1892.6 | 1921.8 | 1907.1 | 1934.3 | 42. | .123 | 1704.2 | 936.8 | 936.8 | 109.15 |
| F1-15 | .1230 | 1881.6 | 1907.6 | 1882.3 | 1906.5 | 27.6 | .047 | 2355.4 | 1294.7 | 1294.7 | 109.15 |
| F2-16 | .0980 | 1857.9 | 1881.1 | 1851.9 | 1873.6 | 20.3 | .025 | 2956.2 | 1625. | 1625. | 109.15 |

*Coiling starts after CM1-12

We claim:

1. A method for hot rolling slabs to strip thickness comprising:

A. close coupling by a distance less than the length of an intermediate workpiece a first and second hot reversing mill having a coiler furnace on the upstream side of said first mill with a finishing train having at least two finishing mills, B. reducing said slab to the intermediate workpiece by passing it back and forth through at least said first hot reversing mill while maintaining roll pairs of remaining mills in an open position in a roughing mode, said slab freely passing through said remaining mills, C. further reducing said workpiece by rolling simultaneously through the first and second hot reversing mills in tandem in an intermediate mode, D. coiling said workpiece in said coiler furnace, E. setting roll gaps on said roll pairs to receive the workpiece in a finishing mode, F. decoiling and directing said workpiece in a downstream direction, and G. reducing said workpiece to said strip thickness by rolling simultaneously through said first and second mills and said finishing train in tandem.

2. The method of claim 1 comprising a twelve pass roll schedule having in sequence, four flat passes through the first hot reversing mill in a roughing mode, two forward tandem passes through the first and second hot reversing mills, two reverse tandem passes through the first and second hot reversing mills into the coiler and four forward tandem passes out of the coiler through all mills into said strip.

3. The method of claim 1 comprising a sixteen pass roll schedule having in sequence two forward tandem passes, two reverse tandem passes, two forward tandem passes, two reverse tandem passes, two forward tandem passes, two reverse tandem passes into the coiler and four forward tandem passes out of the coiler into said strip, whereby all of said two tandem passes are through said first and second hot reversing mills.

4. A method of hot rolling slabs to strip thickness comprising:

A. close coupling by a distance less than the length of an intermediate workpiece a first and second hot reversing mill having a coiler furnace on the upstream side of said first mill with a finishing train having a plurality of mill stands, B. reducing said slab to the intermediate workpiece by passing it back and forth in said hot reversing mills simultaneously in tandem while maintaining roll pairs of the finishing train mill stands in an open position to permit free passage of the slab being reduced, C. coiling said workpiece in said coiler furnace, D. setting roll gaps on said hot reversing mills and said finishing train mill stands to receive the workpiece in a finishing mode, E. decoiling and directing said workpiece in a downstream direction, and F. reducing said workpiece to said strip thickness by rolling simultaneously through said first and second mills and said finishing train in tandem.

* * * * *